US008062479B2

(12) United States Patent
Begemann et al.

(10) Patent No.: US 8,062,479 B2
(45) Date of Patent: Nov. 22, 2011

(54) PAPER MACHINE

(75) Inventors: Ulrich Begemann, Heidenheim (DE); Georg Kleiser, Schwaebisch Gmuend (DE); Hai-Van Nguyen, Dresden (DE); Joerg Reuter, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 12/688,525

(22) Filed: Jan. 15, 2010

(65) Prior Publication Data

US 2010/0175846 A1 Jul. 15, 2010

Related U.S. Application Data

(62) Division of application No. 10/596,071, filed as application No. PCT/EP2004/053086 on Nov. 24, 2004, now Pat. No. 7,871,496.

(30) Foreign Application Priority Data

| | | |
|---|---|---|
| Nov. 28, 2003 | (DE) | 103 55 686 |
| Dec. 12, 2003 | (DE) | 103 58 218 |
| Dec. 16, 2003 | (DE) | 103 58 833 |
| Jan. 27, 2004 | (DE) | 10 2004 003 921 |

(51) Int. Cl.
*D21G 9/00* (2006.01)

(52) U.S. Cl. ..... 162/289

(58) Field of Classification Search ..... 162/289, 162/265, 135, 136, 205, 358.1; 118/325
See application file for complete search history.

(56) References Cited

U.S. PATENT DOCUMENTS

| | | | |
|---|---|---|---|
| 5,952,091 | A | 9/1999 | Horand et al. |
| 6,406,596 | B1 | 6/2002 | Meschenmoser |
| 6,413,371 | B1 | 7/2002 | Ahonen et al. |
| 6,589,388 | B1 | 7/2003 | Nissinen |
| 2004/0050517 | A1 | 3/2004 | Juppi et al. |

FOREIGN PATENT DOCUMENTS

| | | |
|---|---|---|
| DE | 4411987 | 10/1995 |
| DE | 19841768 | 3/2000 |
| DE | 10012344 | 9/2001 |
| DE | 10022087 | 11/2001 |
| DE | 10033213 | 1/2002 |
| DE | 10101866 | 7/2002 |
| EP | 0732446 | 10/1998 |
| WO | 00/55424 | 9/2000 |
| WO | 02/44469 | 6/2002 |

OTHER PUBLICATIONS

"The DF Coater—Coating technology of the new generation" p3326 e 03.03 (which includes "Systems for Finishing", Hirofumi Morita).

*Primary Examiner* — Mark Halpern
(74) *Attorney, Agent, or Firm* — Greenblum & Bernstein, P.L.C.

(57) ABSTRACT

Paper machine for producing paper that can be gravure printed from a fibrous stock suspension, and a related method. The paper machine includes a pressing section having at least one press nip, an impingement dryer arranged immediately after the pressing section, and an applicator. The applicator applies a coating color in the manner of at least one of a curtain application, a film application, or a spraying application.

12 Claims, 7 Drawing Sheets

Fig.7
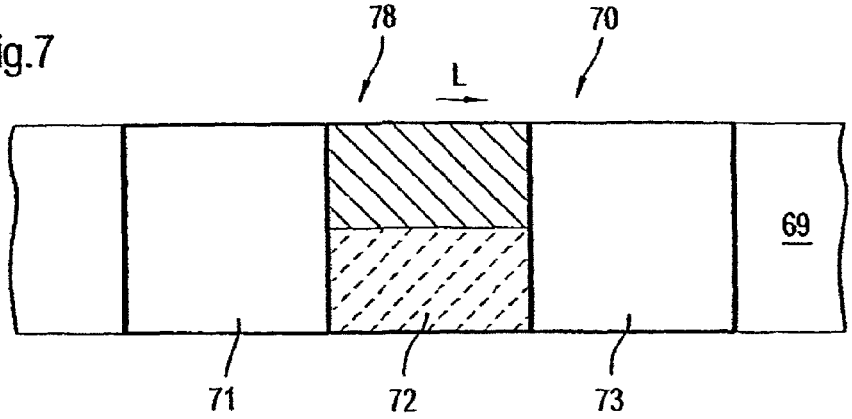
Fig.8
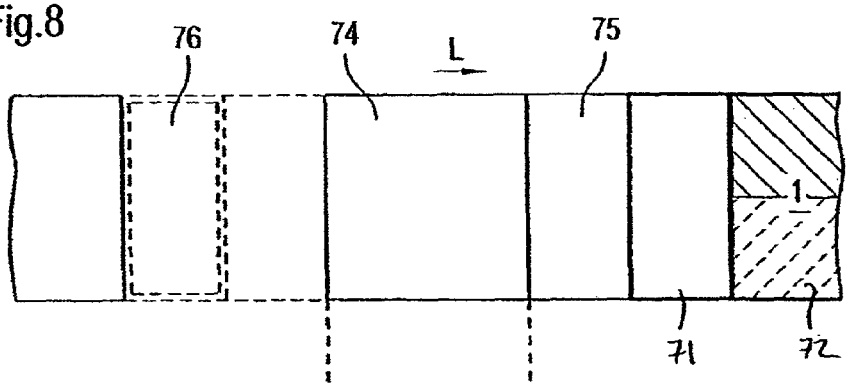
Fig.8a
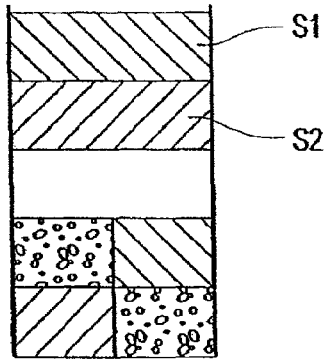
Fig.8b
Fig.9
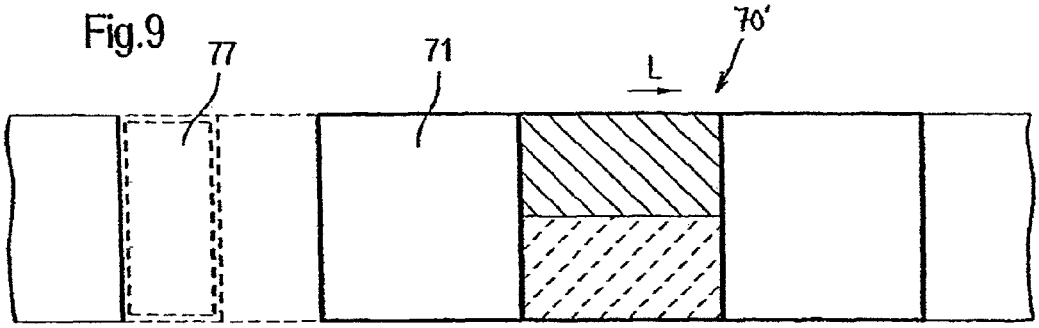

PAPER MACHINE

CROSS-REFERENCE TO RELATED APPLICATIONS

The present application is a Divisional of U.S patent application Ser. No. 10/596,071 filed May 26, 2006, now U.S. Pat. No. 7,871,496, which is a U.S. National Stage of International Application No. PCT/EP2004/053086 filed Nov. 24, 2004 that published as WO 2005/052252 A1 on Jun. 9, 2005. The disclosures of these documents are expressly incorporated by reference herein in its entirety. Further, the present application claims priority under 35 U.S.C. §119 and §365 of German Application No. 103 55 686.9 filed Nov. 28, 2003, German Application No. 103 58 218.5 filed Dec. 12, 2003, German Application No. 103 58 833.7 filed Dec. 16, 2003 and German Application No. 10 2004 003 921.6 filed Jan. 27, 2004.

BACKGROUND OF THE INVENTION

1. Field of the Invention

The invention relates to a paper machine for producing paper that can be gravure printed from a fibrous stock suspension.

2. Description of Background Information

EP 0 732 446 B1 discloses a calender for the two-sided treatment of a paper web, which is in particular also suitable for the production of paper that can be gravure printed. The calender comprises a roll stack which can be loaded from the end and has hard rolls and soft rolls as well as working nips in each case formed between a hard and a soft roll. In this case, some of the rolls can be heated. The stack has six to eight rolls having one roll nip formed by two soft rolls. Two identical stacks each having three or four rolls are provided.

The known calender is connected directly to a paper machine, from which the paper web is supplied. Then, under the guidance of guide rollers, the paper web runs through first working nips between rolls of the calender, a reversing nip, further working nips, and is then wound up into a wound roll. In the first working nips, the paper web rests with one side on the hard rolls and in the further working nips with the other side on the hard rolls, so that the desired surface structure, for example with regard to gloss or smoothness, is achieved on both sides.

In known paper machines, the gravure printing quality of a paper web has hitherto been achieved only by applying a coating color by a blade (blade coat). As a result of this form of application, the paper is loaded highly and, because of the high break tendency of the blade coat, the speed for the online production of the paper web from the fibrous stock suspension as far as a paper coil wound up on a roll is limited to 1400 to at most 1500 m per minute.

SUMMARY OF THE INVENTION

One of the aims of the invention is to provide a paper machine in which paper of gravure printing quality can also be produced at higher speeds, the paper web subsequently being made available wound up on a paper roll.

According to the invention, the paper web is initially produced from a fibrous stock suspension, can then be supplied to a wire section, then to a pressing section, a drying section, a film press having a film roll for applying a coating color, a calender arranged after the film press and can then be wound up to form a roll.

Advantages of the solution according to the invention are that the roughness of the paper surface can be reduced better than with conventional arrangements. The film coated paper has a higher compressibility than the gravure printing paper produced in accordance with the prior art. By the invention, for the first time a film press is provided for producing gravure printing paper from a fibrous stock suspension as far as the paper web finally wound up on a roll. In addition, the film press can also be used at speeds of more than 1500 m per minute.

Advantageous developments of the invention emerge from the subclaims, the description and the drawing.

The initial material used for the paper web is a fibrous stock freed of printing ink. In this case, the fibrous stock is fractionated or classified in accordance with various fiber classes. The coarse fiber proportion, for example the R14 screen residue, is ground separately in order specifically to eliminate the hornification.

In order to achieve a low two-sidedness, for example with regard to the ash content or the roughness of the paper web, gentle dewatering of the fibrous stock suspension is carried out by a twin-wire section equipped with a gap former.

In the pressing section, a tandem NIPCOFLEX® (NIPCOFLEX is a registered trademark of Voith Paper Patent GmbH in the United States and other countries) press with an additional third press, in particular an offset press, is advantageously used, in order to achieve good dewatering with, at the same time, a low two-sidedness of the paper web. Within the pressing section, the paper web is preferably conveyed over a transfer belt. By the use of the offset press, the two-sidedness of the paper web can be reduced to a good smoothness level and good runnability of the paper web can be produced.

The smoothing of the paper web is advantageously additionally improved by a predryer section for predrying the paper web being arranged upstream of the drying section. As a result of the preferable pre-smoothing at a low dryness, preferably at a dryness of less than 80%, after the press section and/or in the predryer section, the surface structure is improved further. In this way, the roughness of the paper web can be reduced to less than 4 μm PPS-S10 (measurement in accordance with the Parker-Print-Surf-S10 method), preferably even to less than 3 μm.

In one advantageous refinement of the paper machine, a smoothing unit, in particular a shoe calender, is arranged upstream of the film press. The shoe calender is also used for the gentle calendering of the paper web. By the smoothing unit, the thickness of the coating body paper can also be calibrated. Such calibration is important in order to subsequently be able to set the correct thickness for applying the coating color in the following film press.

Provision is advantageously made for a float dryer, in particular one operated with thermal radiation, to be arranged between the film press and the calender arranged after the latter.

It is advantageous if the wire section and/or the pressing section have fabrics with fine clothing, in particular felt clothing with a fiber weight of less than 7 dtex. A felt with a low fiber weight can be produced, for example, by easily fusible polymer components being used for this purpose, which are surface-treated by calendering.

As a result of the preferred addition of starch as binder, misting during the application of the coating color is reduced and the surface quality is improved. The proportion of starch is preferably more than 20%, measured in percent by mass, of the entire quantity of binder.

The use of a coating color which has a solids proportion of less than 65%, in particular of less than 60%, preferably of less than 58%, measured in percent by mass, is advantageous. By such a coating color, a sufficiently smooth surface of the paper web can be produced in order to prevent the rapidly immobilizing gravure printing ink producing a rough surface during the film splitting.

The coating color is advantageously also de-aerated mechanically and/or chemically, in order to reduce the air content in it to less than 10%, preferably to less than 7%, measured in percent by mass.

The coating color can be applied to the film roll in various ways, for example by nozzles. The excess coating color is then doctored off the film roll again by a metering rod. The latter preferably has depressions on the circumferential surface, for example in the form of circumferential notches or beads, or it has a spiral depression, by which the color is picked up from the film roll.

In a further advantageous refinement of the paper machine, provision is made for the metering rod to have a diameter of more than 20 mm, preferably more than 24 mm.

The rotational speed of the metering rod is advantageously more than 200 revolutions per minute, preferably more than 250 revolutions per minute.

If the film press roll has a large diameter, in particular of more than 1500 mm, it has a lower nip opening speed at a predefined web speed of the paper web than in the case of a smaller diameter; as a result, the centrifugal force acting on the coating color applied to the circumferential surface of the film roll can also be kept within limits, so that misting of the coating color is largely avoided. During the production of the paper web, the coating operation is carried out without color misting at a web speed of more than 1500 m per minute, preferably at a speed of more than 1700 m per minutes, in order to prevent the ink film coming back onto the film roll from drying out.

In addition, it proves to be advantageous if a unit for moistening the paper web, in particular a nozzle moistener, is arranged upstream of the calender at a distance of less than 1 second, based on the speed of the paper web, in particular of less than 0.6 seconds. Using this, a moisture gradient can be produced from the surface of the paper web. The coating surface is moistened with the object of producing a moisture content of more than 10%.

By the invention, the production of a paper web wound up on a roll and suitable for gravure printing is made possible at high speed, said paper web having a coating with a low weight; the paper web is therefore also designated "light weight coated". The result of all of the measures is that, on the side to be printed, there is a roughness according to PPS-S10 of less than 6 μm, preferably of less than 4 μm, and that the compressibility is increased, the specific volume lying in the order of magnitude of 0.9 to 1.0 $cm^3/g$.

The invention relates further to a paper machine for producing a paper, board, tissue or another fibrous web having a pressing section with at least one press nip and having an impingement dryer arranged immediately after the pressing section.

DE 100 22 087 A1 discloses a pressing section for a paper machine having two press nips, through which a common top felt and bottom felt run. The second press is a shoe press, whose shoe press roll is located above the bottom roll. The pressing plane of the second roll runs substantially horizontally or inclined with respect to the vertical at an angle of at most 20°. In this pressing section, the bottom felt led through the two press nips is so dense that, even in the new state, it is substantially air-impermeable after being wetted. On the other hand, the common bottom felt is still sufficiently air-permeable to let water in the press nips through at pressures of more than six bar. The two top felts are so open that, in the wet, uncompressed state, they let air through. The pressing plane of the first press is inclined with respect to the vertical at an angle of more than 20°.

DE 198 41 768 A1 describes a drying section for a machine for producing a material web, in particular a paper or board web. At least one impingement dryer is provided, by which a hot air and/or hot steam flow can be applied to at least one side of the material web. According to some embodiments of the drying section described in DE 198 41 768 A1 (FIGS. 2, 4, 5), the material web coming from the pressing section is picked up from the press felt by a single suction roll and then led either over a single cylinder (FIGS. 2, 4) or over a large number of rollers (FIG. 5), which are arranged substantially circularly in relation to one another. By these configurations of impingement dryers, it is not necessary to lead the still relatively wet material web over smooth contact surfaces in order to achieve an adequate heat transfer.

As a result of avoiding smooth contact surfaces at the start of the drying, the risk of web breaks and the over-stretching of the edges of the web are substantially eliminated. Therefore, high drying rates are possible, which results in the overall length of the drying section being shortened accordingly. Therefore, at the start of the drying operation, the drying performance is only limited by the effect on the paper quality at an excessively high drying speed and no longer by the web guidance of the wet paper web. In addition, by using the impingement dryer, which can be regulated flexibly and quickly, the paper quality can be influenced specifically. As a result, at the start of the drying phase, correction of transverse moisture profiles is in particular also possible with specific heating and drying.

In known paper machines, there is now the problem that, when the paper web is led through the coating unit, the strength of the paper web decreases as a result of the rewetting resulting from the application of the coating color. Moreover, this decrease in strength can lead to web breaks. Coating processes which wipe off the excess coating color with a doctor blade therefore prove to be susceptible to faults, since a high pressure gradient occurs in this case (blade coat). As a result of this form of application, the paper is loaded highly and, because of the high break tendency of the blade coat, the web speed for the online production of the paper web from the fibrous stock suspension as far as a paper coil wound up on a roll is limited to 1400 to at most 1500 m/min.

Moreover, one of the aims of the invention is to provide a paper machine in which a gentle coating process can be implemented even at high web speeds.

According to a first aspect of the invention, a paper machine of the type mentioned at the beginning in that it has an applicator for applying a coating color in the manner of a curtain or for the film application or for spraying coating color on. This paper machine is particularly suitable for producing LWC ("light weight coated") paper which is distinguished by good printability, in particular in the gravure printing sector.

By the combination of an impingement dryer arranged immediately after the pressing section with a device for applying the coating color in the region of the drying section following in the machine running direction, the potential speed and the runnability of a paper machine can be increased considerably and, at the same time, good runnability with good paper web surfaces is achieved.

Both when using a curtain applicator and when using a film press and also in the sprayed application of a medium, in particular coating color, the paper machine can be used up to web speeds (machine speeds) of more than 1500 m/min, preferably of more than 1700 m/min, in particular of more than 1800 m/min.

The invention relates, furthermore, to a method and an arrangement for producing a woodfree coated, matt or semi-matt paper web.

Nowadays, woodfree coated (WFC) papers are coated once or many times and are subsequently lightly calendered or even not calendered. In this case, there is a fixed relation between the gloss and the roughness of the paper, which can be changed only by intervening in the coating formulation within specific, but highly limited, limits. The finish of the paper is, moreover, determined to a very great extent by the possible calendering process.

As a result of the aforementioned dependence, only the production of a woodfree coated paper web with limited qualities is possible.

It is therefore a further aim of the invention to present a method and arrangement for producing a woodfree coated paper web which permit the production of paper webs in new quality ranges, in particular for matt and semi-matt WFC grades.

According to a further aspect of the invention, the paper web is pre-calendered by at least one pre-calendering device, then is coated on at least one side by at least one device for applying liquid or pasty application medium, and is then dried by at least one drying device, in order to produce as a result a woodfree coated, matt or semi-matt paper web having a roughness in the range from 0.8 to 3.9 μm (PPS) and a gloss in the range from 3 to 35% (TAPPI 75°).

This combination, according to the invention, permits a push forward into new quality ranges for WFC grades, in particular for matt and semi-matt WFC grades. By the method according to the invention, the coated paper can be produced in a manner maintaining volume and the requisite calendering work can be reduced considerably. The roughness of the paper web following the pre-calendering, at <6 μm, in particular <5 μm, in particular in the case of single-coated paper webs, that is to say in the case of paper webs that are not pre-coated, is >1.4 times the final roughness of the finished paper web. The possibility is therefore created of producing a paper web with a very low roughness and a low gloss.

Therefore, the dependence between the roughness and the gloss, known generally, is reduced considerably by the novel process, which makes the production of new paper qualities possible.

In this case, particular attention is paid to the pre-calendering immediately before the last application; it is necessary to produce the desired smoothness as early as here in order that, after the further following application, in particular by non-contact curtain coating, the desired finish is already achieved. As a result of dispensing with the previous calendering after the last application, it is possible to set the required gloss merely by the composition of the application medium.

Furthermore, the pre-calendering is very advantageous for the application, in particular by non-contact curtain coating, since as a result the requirements on the viscoelasticity of the application medium are reduced and a good application quality is ensured.

Furthermore, the overall process for producing woodfree coated, matt or semi-matt paper webs is simplified, since the previous final supercalendering is dispensed with and the overall process can preferably be configured as an online process.

In a first preferred refinement, before its pre-calendering, the paper web is coated by at least one device for applying liquid or pasty application medium. The coating is preferably carried out singly on a first side by a film application device or a curtain application device, singly on both sides by a film application device, or singly on both sides by a curtain application device. The compositions of the coating colors, the respective coat weights and the like can vary.

After this coating, the paper web is dried in a known way.

Furthermore, provision can be made for the paper web to be led through at least one film press before the first application of liquid or pasty application medium. As a result, a possible first thickness calibration of the paper web is ensured in an effective and simple manner.

In a further preferred refinement, the paper web is pre-calendered by a smoothing unit, by a shoe calender having at least one extended nip and a smoothing unit, by a soft calender having at least one nip, or by a supercalender having at least one nip. These pre-calibration devices are excellently suitable for this purpose and are distinguished by a process reliability, which is necessary for the production process according to the invention, with beneficial operating costs.

After that, the paper web is coated singly on a first side by a device for applying liquid or pasty application medium, in particular a curtain application device. Additionally or alternatively, the paper web is coated singly also on a second side or only on a second side by a further device for applying liquid or pasty application medium, in particular a curtain application device. The composition of the at least one coating color, the coat weight and the like can vary.

After this coating, the paper web is dried for the first time or again in a known way.

Once more, provision can be made for the paper web to be led through at least one film press before it is pre-calendered if the paper web is merely single-coated. As a result, a possible first thickness calibration of the paper web is ensured in an effective and simple manner.

According to the invention, the aim of the invention is achieved in an arrangement in that, in the running direction of the paper web, it has at least one device for pre-calendering the paper web, at least one device for applying liquid or pasty application medium to the paper web, and at least one device for drying the paper web.

In a first preferred refinement, in the running direction of the paper web, at least one further device for applying liquid or pasty application medium to the paper web and a further device for drying the paper web are arranged upstream of the device for pre-calendering the paper web.

The device for pre-calendering the paper web preferably comprises at least one smoothing unit, a soft calender having at least one nip, a supercalender having at least one nip, or a shoe calender having at least one extended nip.

In this case, the smoothing unit can have two hard cast rolls, the soft calender can have one hard cast roll and one roll provided with a plastic covering, and the supercalender can have one hard cast roll and one paper roll, the aforementioned pairs of rolls forming a nip with each other.

Furthermore, the device for applying liquid or pasty application medium is a device acting without contact or one contacting the paper web.

In this case, the device acting without contact can have a curtain application apparatus (curtain coating) or a spray application apparatus (spray coating), and the device contacting the paper web can have a line application apparatus (Jet-Flow) or a film application apparatus (film coating).

The device for drying the paper web has an impingement dryer and/or an IR drying unit. These drying devices are excellently suited for this purpose and are distinguished by a process reliability needed for the production process according to the invention with beneficial operating costs.

In a supplementary refinement, in the running direction of the paper web, at least one film press can be arranged upstream of the device for pre-calendering the paper web or the device for applying liquid or pasty application medium to the paper web. As a result, a possible first thickness calibration of the paper web is ensured in an effective and simple manner.

In a particular embodiment, it is also possible for the arrangement according to the invention to form one unit with a paper machine. Therefore, the woodfree coated, matt or semi-matt paper web can be produced online and process steps needed hitherto, such as the winding and unwinding of the paper web in the production process, are dispensed with.

The invention moreover relates to a process for applying an application medium.

During the production and/or finishing of a material web, in particular a paper or board web, a uniform application reaching over the entire web width is needed. This is necessary in order to ensure the subsequent printability of the same.

The application to the dry web is carried out in the form of coating color, size or starch, using appropriate application devices.

During the application, large quantities of moisture are often introduced into the web, which results in the tensile strength of the web being decreased. It is, therefore, easy for web breaks to occur, above all in the free draw after a coating unit. This is all the more frequently the case the faster the webs run, the wider the latter are and additionally also depends on the quality of the material web.

It can be gathered from DE-A1 100 33 213 that a predried material web having a dryness of 85 to 95%, in particular a paper or board web, is coated in an indirect manner. In this case, the indirect application is first made to an applicator roll, with which the application medium is transferred to one side of the material web. The uncoated side of the material web is carried by a supporting belt at this time. In order to avoid free draws of the material web, the supporting belt is therefore led as far as the afterdryer section.

This signifies high expenditure on apparatus.

In the solution specified in DE-A1 101 01 866, the coating medium is applied to the material web in direct form. The material web is in this case likewise again carried by a supporting belt as far as a subsequent treatment location, the application layer being dried without contact on a long rectilinear web path.

Here, too, the expenditure on apparatus and all the activities in connection with the cleaning of such a "long" supporting belt is high.

It is therefore a further aim of the invention to specify a simpler process and a more compact, more simply constructed device so as to avoid, but at least to reduce, web breaks following the application of an application medium to a moving material web, in particular, of paper or board.

According to a further aspect of the invention, during the application of the application medium and during the non-contact drying of the medium layer applied, the material web runs over one and the same supporting surface. As a result, above all, short web running paths are achieved, which results in high web running properties without free draws being possible. As a result, web breaks are largely avoided.

It is particularly advantageous if the supporting surface used is a rotating roll around which the material web wraps over a wrap angle of about 180° to 210°. Therefore, in addition to the support of the material web, a web deflection is likewise achieved.

One advantage of the invention is that the material web can be treated on both sides more simply than otherwise. In order to treat the material web on both its sides, it is then only necessary for a second supporting surface to be arranged symmetrically with respect to the first.

In a very expedient way, during its two-sided treatment, the material web is first led around the first supporting surface in order to treat one web side, deflected in the process—as stated—and then led around the second supporting surface in order to treat the other web side and again deflected in the process. This is all carried out in an extremely small space, which firstly reduces the apparatus costs and secondly ensures better web running properties. One particular advantage is that higher machine speeds can be implemented as a result.

The process can be configured advantageously if the application of the coating medium is carried out in an indirect way, the coating medium first being applied to an applicator roll, by which the coating medium is then discharged to the material web in a nip existing between the applicator roll and the supporting surface.

As a result, the medium layer applied is very thin and already evened out. In addition, splashing as the material web is deflected at the nip exit can be avoided.

In specific cases, however, it is also expedient to carry out the application of the liquid to pasty medium in a direct way.

In the case of direct or else indirect application, the application can be carried out, for example, with a nozzle applicator, for example an SDTA (short dwell time applicator) or a pressure-assisted free jet nozzle applicator. In this case, the application medium is applied in excess and then doctored off to the desired coat weight by a doctor device.

It is also conceivable to carry out the application with an application device acting without contact. Using such a device, for example, a spray applicator or a curtain applicator, what is known as a 1:1 application is possible. Via a large number of pressure-assisted individual application nozzles in the case of the spray applicator, and with a curtain substantially following the force of gravity and emerging from a machine-width application nozzle in the case of a curtain applicator, only so much application medium is applied as is finally intended to remain on the material web side.

The non-contact drying of the application layer on the material web, immediately following the coating, may be performed most effectively with radiation dryers, for example infrared and/or convection dryers, for example air dryers. The non-contact dryers are likewise assigned to the supporting surface.

A further very advantageous refinement of the process according to the invention can include the dried application layer being calendered immediately thereafter.

A smoothing unit provided for this purpose is likewise assigned to the supporting surface. As a result of this procedure, an online smoothing process can be operated very effectively. At this time, that is to say after the treatment using the non-contact dryers, the application medium has not yet completely hardened. As a result, the smoothing unit can be operated with lower pressures than generally usual. This has a very positive effect on the volume of the finished web, in particular of the finished paper.

The material web can then be supplied to treatment locations arranged downstream, for example to an afterdryer section.

In order to carry out the process, the invention provides an apparatus having a rotational speed of the metering rod of more than 200 revolutions per minute and preferably more than 250 revolutions per minute.

According to the invention, there is therefore a supporting surface around which the material web runs both during the medium application and also during the drying of the application layer, and which also deflects the material web either to the next treatment location or in order to treat the other web side.

The supporting surface provided is advantageously a roll, which can be designated a backing roll. A roll of this type is easier to clean than a circulating supporting belt, which could likewise be used as a supporting surface.

In addition, a supporting roll can also be heated, by which the drying process of the application layer is intensified.

On its external circumference—as already explained above—the supporting surface can be assigned relatively simply non-contact dryers, such as infrared and/or air dryers.

It is expedient if the supporting surface is assigned an applicator roll for applying the application medium in an indirect way. This applicator roll forms a nip with the supporting surface, in which nip the application medium is transferred to the material web.

The ratio of the diameter of the supporting surface to the diameter of the applicator roll is approximately 4:1, by which the application layer can be applied particularly uniformly.

In order to be able to contrive an online smoothing process, which brings cost and process engineering advantages, a smoothing unit can be arranged downstream of the non-contact dryers. This smoothing unit, just like the application device or applicator roll and the non-contact dryers, is assigned to the same supporting surface.

There is therefore an arrangement which is very compact and can be monitored more easily than hitherto.

The apparatus can be used very advantageously for two-sided treatment (coating, drying, smoothing) of the material web. For this purpose, there are two of the supporting surfaces described, the material web running from the first supporting surface for the purpose of treating one web side to the second supporting surface for the purpose of treating the other web side.

The two supporting surfaces are arranged at a short distance from each other, which ensures extremely short web paths. The two axes of the supporting surfaces may expediently be arranged in one plane, as a result of which the free draw present between the two supporting surfaces may be shortened to a minimum and, as a result, the risk of a web break decreases considerably.

Further advantageous refinements are recorded in further subclaims.

The invention may be used in particular in machines for producing and/or finishing material webs, in particular of paper or board, which are to be operated at high web speeds of about 2000 m/min and more. The invention is also practical in the case of required high web widths of 10 m and more.

It is important that the various aspects of the invention illustrated can be combined with one another as desired for a large number of applications. Thus, the disclosure of the invention is not intended to be restricted to the respective aspects in detail and the respective exemplary embodiments in detail; instead, any desired combination of the various aspects and features from various exemplary embodiments is possible.

BRIEF DESCRIPTION OF THE DRAWINGS

In the following text, the invention will be explained in more detail by using exemplary embodiments.

FIG. 7 shows a schematic illustration of an arrangement according to the invention in accordance with the third aspect of the invention;

FIGS. 8, 8*a* and 8*b* show further schematic illustrations of two arrangements according to the invention;

FIG. 9 shows a schematic illustration of an arrangement according to the invention;

DETAILED DESCRIPTION OF THE EMBODIMENTS OF THE INVENTION

Figure 1:
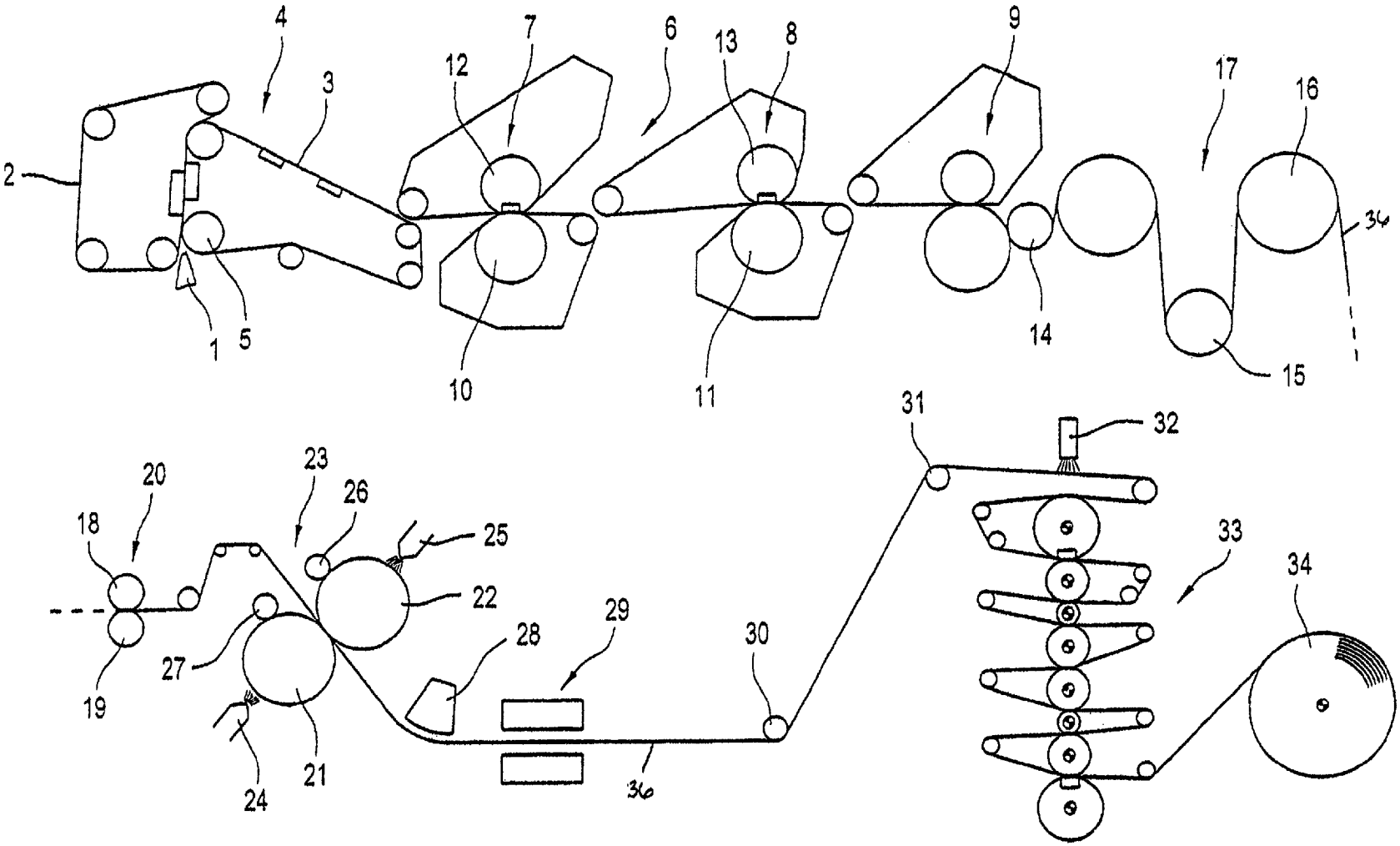
FIG. 1 shows the schematic structure of a paper machine according to the invention according to the first aspect of the invention.

From a headbox 1, a fibrous stock suspension is supplied to a gap between two fabrics 2 and 3 of a twin-wire former 4, which carefully produces a paper web 36 that is uniform on both surfaces. On the radius of a forming roll 5, the fabrics 2, 3 run toward each other in a wedge shape and enclose the fibrous stock suspension between them. In the process, first dewatering of the fibrous stock suspension takes place, and a fiber mat is formed, from which the paper web 36 is produced.

The twin-wire former 4 is followed by a pressing section 6. The pressing section 6 comprises, for example, as illustrated, three pressing locations 7, 8, 9. The first two pressing locations 7, 8 form a tandem NIPCOFLEX pressing section, in which in each case a roll 10, 11 interacts with a shoe press roll 12, 13. A pressing section 6 of this type having two pressing locations 7, 8 is disclosed, for example, by DE 100 22 087 A1, of which the disclosure to this extent is also appended to the content of the present application. The third pressing location 9 is an offset press.

The pressing section 6 is followed by a predryer section 14. The paper web 36 then runs through a drying section 17 having deflection rolls 15 and drying cylinders 16. It goes without saying that the drying section 17 has a large number of drying cylinders 16 in order to dry the paper web preferably from both sides, and that extensive depiction of all the drying cylinders 16 has been omitted only for reasons of a clear illustration.

After the drying section 17, the paper web 36 is led through between a shoe roll 18 and a roll 19 of a shoe calender 20 used as a smoothing unit. Via deflection rolls (not labeled), the paper web 36 reaches a film press 23 having two film rolls 21, 22.

An application nozzle 24 or 25 applies a film of the coating color in excess to each of the two film rolls 21, 22, said film being doctored off in each case by a metering rod 26, 27.

The paper web 36 is then led onward by a deflection element 28 operating with air pressure to a float dryer 29, by which the paper web 36 is dried on both sides by thermal radiation or hot air. Over further deflection rolls 30, 31, the paper web 36, now dried again, is led onward to a nozzle moistener 32, by which the paper web 36 is rewetted again to a predefined moisture level and moisture gradient. It goes without saying that rewetting can also be carried out on the underside of the paper web 36.

After the nozzle moistener 32, the paper web 36 is calendered in a calender 33 known from EP 0 732 446 B1. The paper web 36 leaving the calender 33 is then wound up onto a paper roll 34. Thus, in the paper machine according to the invention, a paper web 36 suitable for gravure printing is produced at high speed in a single continuous production process.

Figure 2:
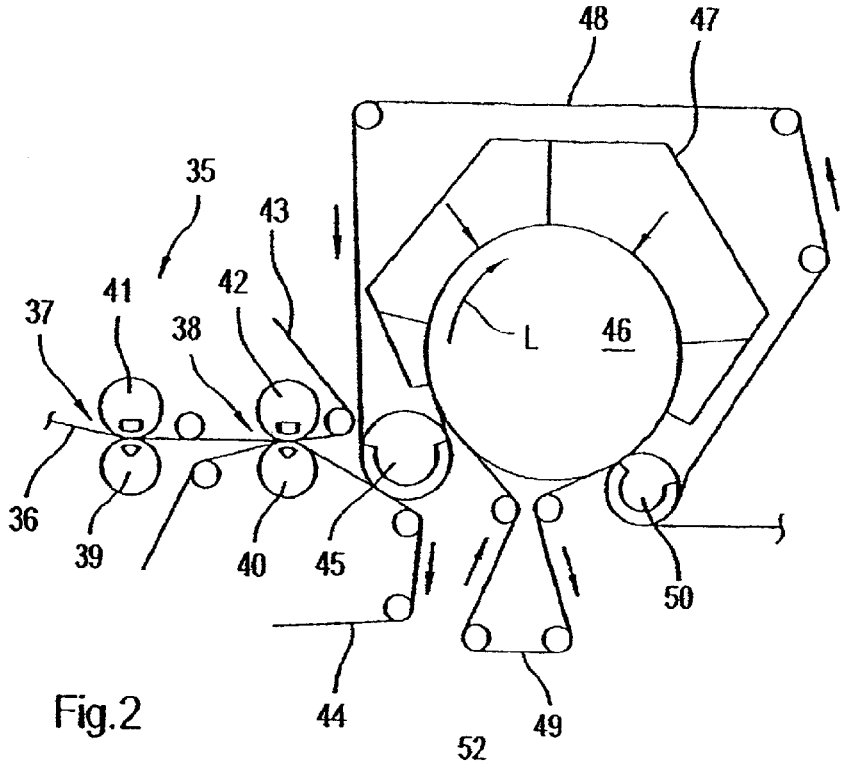
FIG. 2 shows the schematic structure of a pressing section and of an impingement dryer following the latter according to the second aspect of the invention.

A pressing section 35 (FIG. 2), from which a paper web 36 is led out, comprises, for example, two press nips 37, 38, which are in each case formed by a press roll 39, 40 and a shoe press roll 41, 42 interacting with the latter. The press nips 37, 38 form what is known as a tandem NIPCOFLEX press, as is already known per se from DE 100 22 087 A1. The fibrous web 36 is guided by press felts 43, 44. Depending on the machine configuration and process requirements, a known transfer belt can also be used. By a suction roll 45, the paper web 36 is removed from the press felt 44 and transferred to the circumference of a larger supporting roll 46, which is surrounded by an impingement dryer 47. The paper web 36 is guided with its side opposite the impingement dryer 47 over an open supporting surface, that is to say one which is porous and not smooth. For this purpose, there is a top fabric 48. On its side opposite the supporting roll 46, the paper web 36 runs over a bottom fabric 49. Together with the latter, the paper web 36 is removed from the supporting roll 46 by a suction roll 50. The paper web 36 then runs through a drying section of known design, as is disclosed, for example, by DE 198 41 768 A1.

Figure 3:
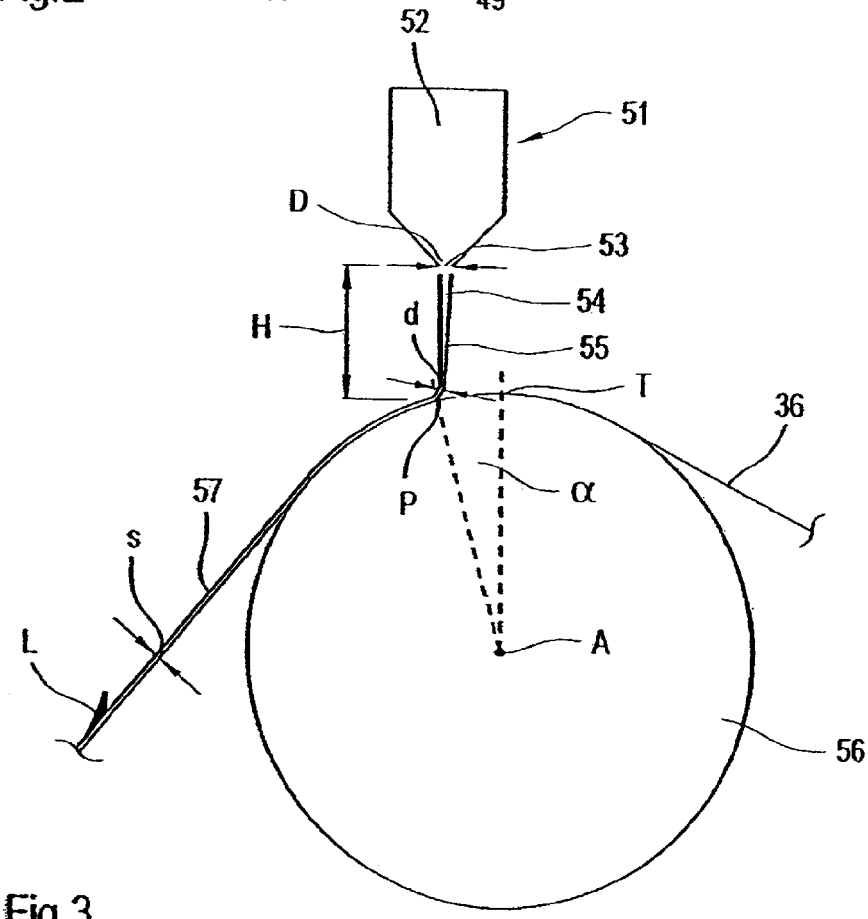
FIG. 3 shows an apparatus for the curtain application of the coating color.

Furthermore, in the paper machine, for example following a smoothing unit arranged after the drying section, there is a curtain applicator already known from DE 100 12 344 A1 and designated 51 (FIG. 3), which comprises a distribution chamber 52 with a discharge nozzle 53, through which an application medium 54 is discharged onto the paper web 36 which is moving in the direction of an arrow L and which, in the region of an impingement position P of the curtain 55, is led around a supporting roll 56.

The discharge nozzle 53 is at a distance H from the impingement position P. Over this drop height H, the application medium 54 emerging from the discharge nozzle 53 falls onto the paper web 36 substantially under the influence of the force of gravity. Since the application medium 54 is accelerated over this falling distance, the thickness of the curtain 55 decreases from a value corresponding to the width D of the discharge nozzle 53 to a value d immediately before striking the paper web 36. On account of the difference between the speed of the falling curtain 55 immediately before impinging on the paper web 36 and the speed of the paper web 36, the application medium 54 is stretched again upon contact with the paper web 36, so that the thickness of the layer 57 applied to the paper web 36 only has the value s.

The curtain applicator 51 is arranged relative to the supporting roll 56 in such a way that, relative to the running direction L of the paper web 36, the point of impingement P is arranged downstream of the vertex T of the circumferential surface of the roll 56. The angle $\alpha$ formed by the connecting line through the point of impingement P and the roll axis A and the connecting line through the vertex T and the roll axis A is preferably between 0° and about 45°, in order firstly to be able to prevent the application medium 54 from running away on the paper web 36 counter to the running direction L of the paper web 36 and to be able to prevent the entry of air between the paper web 36 and the application layer 57.

In another exemplary embodiment (FIG. 4), the paper web 36 is led through between two film rolls 58, 59 of a film press 60 instead of the curtain applicator 51.

An application nozzle 61 or 62 applies a film of the coating color in excess to each of the two film rolls 58, 59, film in each case being doctored off by a metering rod 63, 64.

By the coating color used in the film press 60, the thickness of the paper web can be calibrated. Good calibration of the thickness of the coating body paper can be achieved in particular when the film press 60 operates with a coating color containing starch as binder. By adding the binder, misting during application of the coating color is avoided. The proportion of the binder preferably amounts to more than 20% of the color applied. The binder used is advantageously starch.

Generally advantageous is the use of a coating color which has a solids proportion of less than 65%, in particular of less than 60%, preferably of less than 58%, measured in percent by mass. By such a coating color, a very smooth surface of the paper web 36 can be produced.

Furthermore, the coating color preferably has a viscosity in the range from 500 to 800 Pa·s which, inter alia, provides good processing possibilities.

The coating color is advantageously also deaerated mechanically and/or chemically, in order to reduce the air content in it to less than 10%, preferably to less than 7%.

Figure 4:
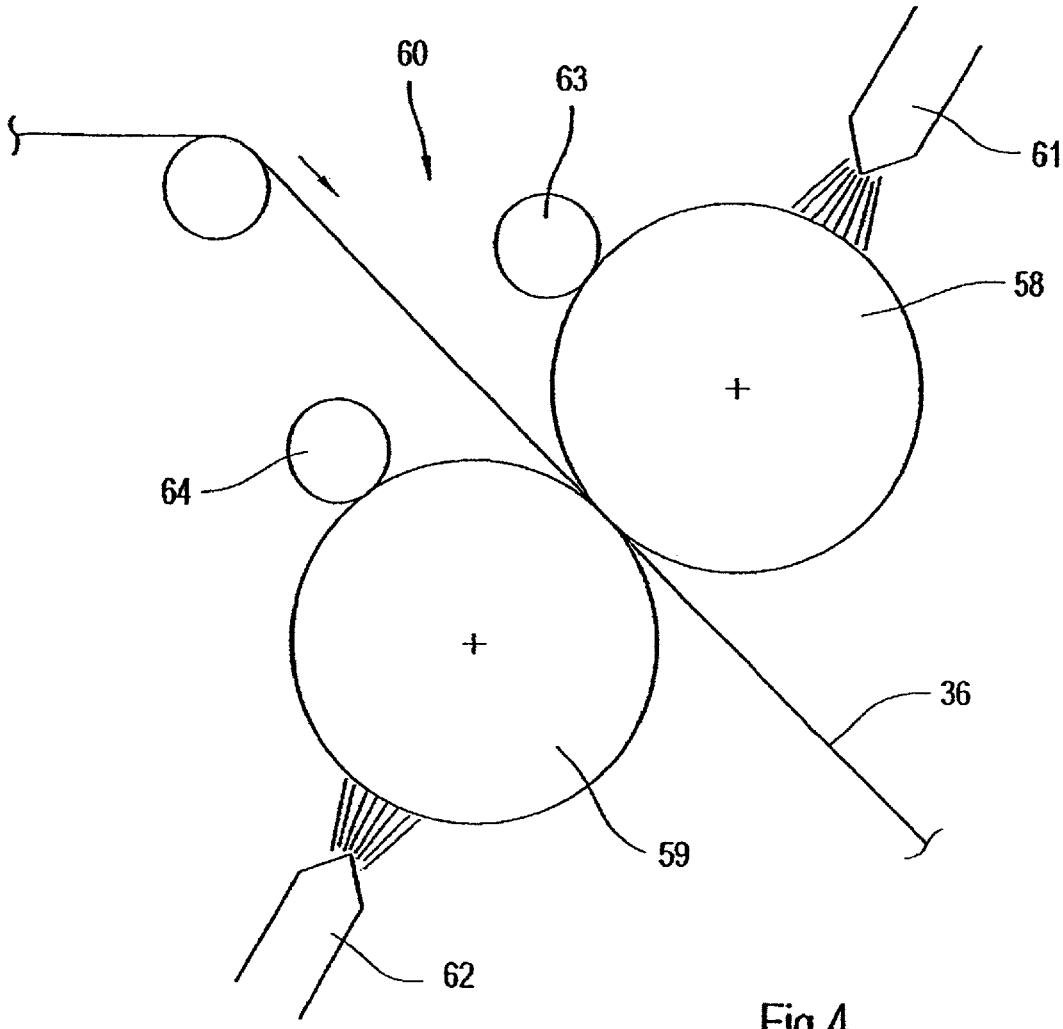
FIG. 4 shows an apparatus for the film application of coating color by film rolls.

The coating color can be applied to the film rolls 58, 59 in various ways, for example by the application nozzles 61, 62 illustrated in FIG. 4. The metering rods 63, 64, by which the excess coating color is doctored off the film rolls 58, 59 again, preferably have depressions on their circumferential surface, for example in the form of circumferential notches or beads, or the metering rods 63, 64 have a spiral depression, by which the color is picked up from the film roll 58 or 59 and also metered.

If the film rolls 58, 59 have a large diameter, in particular of more than 1500 mm, they have a smaller angular velocity at a predefined web speed of the paper web 36 than in the case of a smaller diameter. As a result, the centrifugal force acting on the coating color applied to the circumferential surface of the film rolls 58, 59 can also be kept within limits, so that misting of the coating color is largely avoided. The coating operation can be carried out at a web speed of more than 1500 m/min, preferably of more than 1700 m/min, in particular of more than 1800 m/min.

Figure 5:
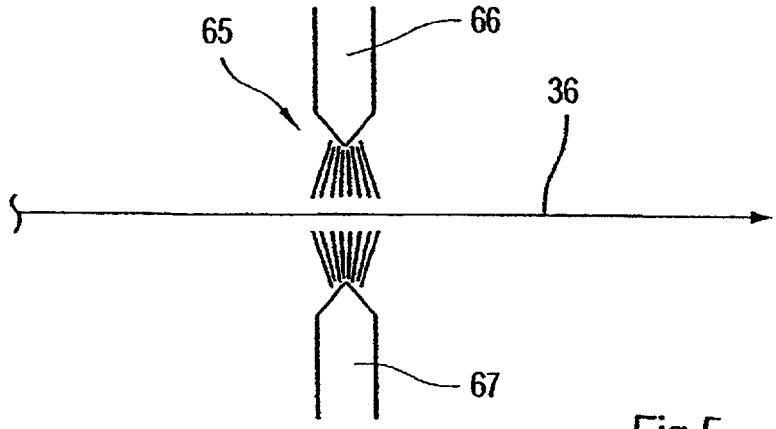
FIG. 5 shows a spraying apparatus for applying the coating color.

In a further alternative, instead of the curtain applicator 51 and instead of the film press 60, a nozzle arrangement 65 (FIG. 5) having two nozzle bars 66, 67 extending over the entire width of the paper web 36 is provided, from which the application medium is applied to the paper web 36 distributed two-dimensionally in the manner of a spray. In this case, there is the possibility of a 1:1 application of the application medium to the paper web 36.

Figure 6:
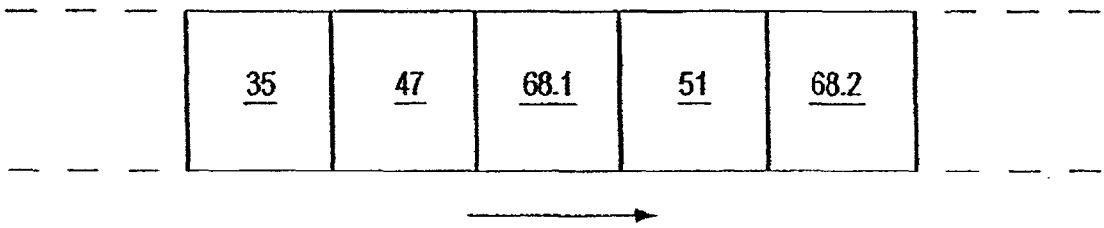
FIG. 6 shows an illustration of an online process for producing the paper web.

As shown in FIG. 6, an online process for producing the paper web can, for example, comprise a pressing section 35 having at least one press nip, an impingement dryer 47 arranged immediately after the pressing section 35, a first part of a drying section 68.1, an applicator 51 for applying a coating color in the manner of a curtain or for the film application or for spraying coating color on, and then a second part of a drying section 68.2.

FIG. 7 shows a schematic illustration of an arrangement 70 according to the invention for producing a woodfree coated, matt or semi-matt paper web 69.

The paper machine 78 for producing the paper web 69 comprises, in a known way, the sections comprising headbox, wire section, pressing section, drying section and winder, none of them explicitly illustrated. The general construction of a paper machine and its sections is described in a large number of documents and is very well known to the appropriate person skilled in the art.

In the running direction L (arrow) of the paper web 69, the arrangement to comprises at least one device 71 for pre-calendering the paper web 69, at least one device 72 for applying liquid or pasty application medium to the paper web 69, and at least one device 73 for drying the paper web 69.

The device 71 for pre-calendering the paper web 69 comprises at least one smoothing unit, a soft calender having at least one nip, a supercalender having at least one nip or a shoe calender having at least one extended nip.

In this case, the smoothing unit can have two hard cast rolls, the soft calender can have one hard cast roll and one roll provided with a plastic covering, and the supercalender can have one hard cast roll and one paper roll, the aforementioned pairs of rolls forming a nip with each other. A soft calender having a plurality of rolls is known, for example from European patent EP 0 732 446 B.

Furthermore, the device 72 for applying liquid or pasty application medium is a device acting without contact or a device making contact with the paper web 69.

In this case, the device acting without contact can have a curtain application apparatus (curtain coating) or a spray application apparatus (spray coating), and the device making contact with the paper web can have a line application apparatus (JetFlow) or a film application apparatus (film coating). A curtain application method together with application apparatus is known, for example from the German laid-open specification DE 100 12 344 A1 and the VOITH document "The DF coater—Coating technology of the new generation" p3326 e 03.03 (which includes "Systems for Finishing", Hirofumi Morita).

The device 73 for drying the paper web 69 has an impingement dryer and/or an IR drying unit. However, it is of course also possible for still further drying systems and principles to be used.

The device 71, 72 and 73 are illustrated with a thick border in the schematic illustration, in order thereby to express their importance.

By this arrangement 70, the performance of the process according to the invention is therefore made possible. This is characterized in that the paper web 69 is pre-calendered by at least one device 71 for pre-calendering, then is coated on at least one side by at least one device 72 for applying liquid or pasty application medium, and is then dried by at least one device 73 for drying, in order as a result to produce a woodfree coated, matt or semi-matt paper web 69 having a roughness in the range from 0.8 to 3.9 μm (PPS) and a gloss in the range from 3 to 35% (TAPPI 75°).

It can be seen clearly in FIG. 7 that the devices 71, 72 and 73 as part of the arrangement 70 form one unit with the paper machine 78. The process steps according to the invention are therefore carried out online in the production of the woodfree coated, matt or semi-matt paper web 69.

FIGS. 8, 8*a* and 8*b* show further schematic illustrations of two configurations according to the invention.

In this case, in the running direction L (arrow) of the paper web 69, at least one further device 74 for applying liquid or pasty application medium to the paper web 69 and a further device 75 for drying the paper web 69 are arranged upstream of the device 71 for pre-calendering the paper web 69.

The further device 74 for applying liquid or pasty application medium to the paper web 69 is once more a device acting without contact or a device making contact with the paper web 69 (cf. FIG. 7). It is preferably designed as a film or a curtain application apparatus and coats the paper web 69 singly on a first side S1 or singly on both sides S2. As schematically illustrated in FIG. 8, the single-sided coating of the paper web 69 can be carried out on the top side or underside, and the two-sided coating of the paper web 69 can be carried out simultaneously (cf. FIG. 8*a*), overlapping in time or offset in time (cf. FIG. 8*b*).

Furthermore, the further device 75 has an impingement dryer and/or an IR drying unit for drying the paper web 69 (cf. FIG. 8). However, it is of course also possible for further drying systems and principles to be used.

In the running direction L (arrow) of the paper web 69, at least one film press 76 of known design and function (illustrated by double lines) for the possible first thickness calibration of the still uncoated paper web 69 is arranged upstream of the further device 74 for applying liquid or pasty application medium to the paper web 69. Of course, still further units and devices of known type (dashed illustration) used for the production process of the woodfree coated, matt or semi-matt paper web 69, can be arranged between the film press 76 and the device 74.

FIG. 9 shows a further schematic illustration of a configuration according to the invention.

This arrangement 70' resembles in principle the arrangement 70 of FIG. 7, reference hereby being made to the latter.

In this case, in the running direction L (arrow) of the paper web 69, provision is made for at least one film press 77 (illustrated by double lines) of known design and function to be arranged upstream of the device 71 for applying liquid or pasty application medium to the paper web 69, for the possible first thickness calibration of the still uncoated paper web 69. Of course, still further units and devices of known type (dashed illustration) used for the production process of the woodfree coated, matt or semi-matt paper web 69, can be arranged between the film press 77 and the device 71.

Figure 10:
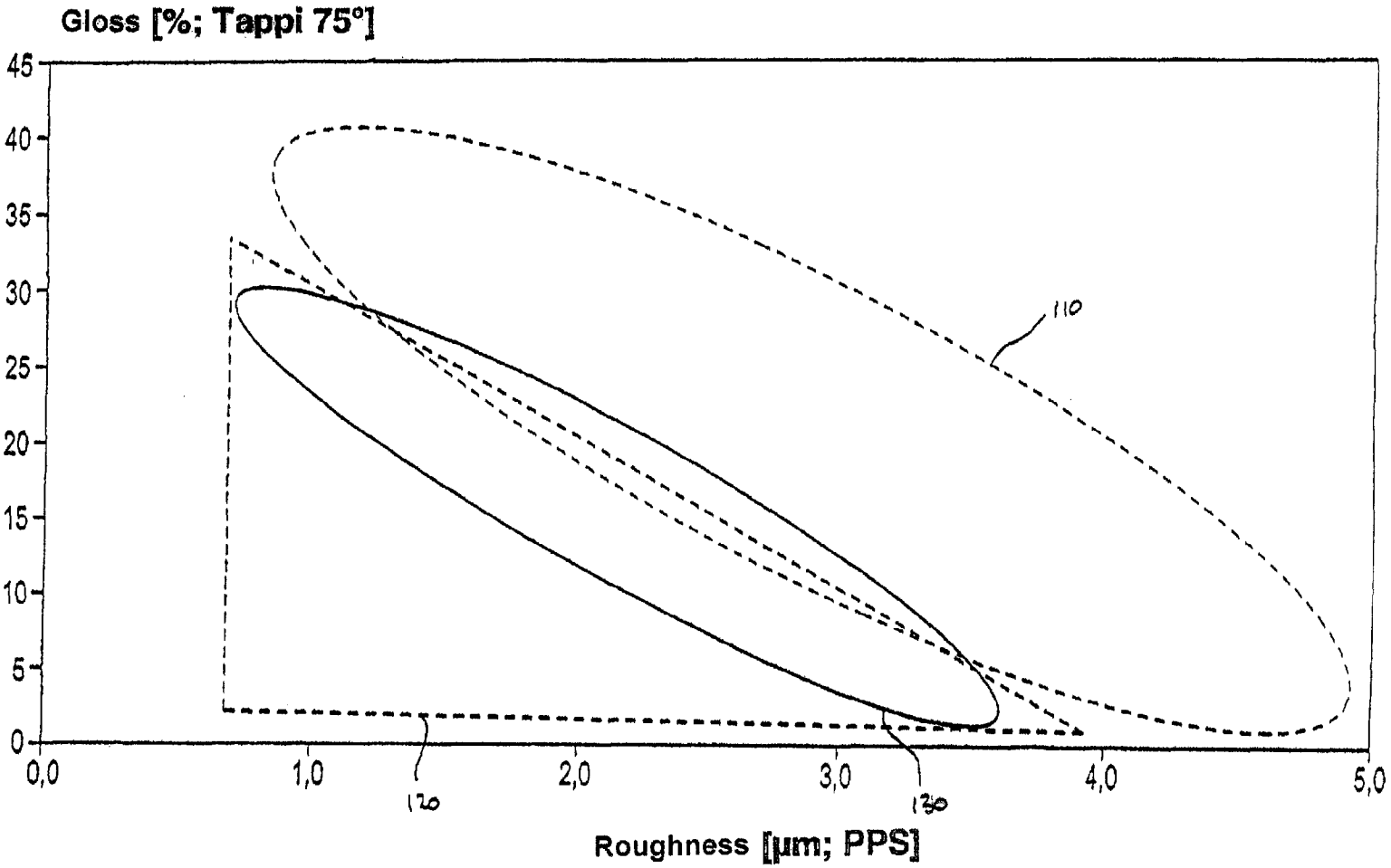
FIG. 10 shows a roughness-gloss graph according to the invention.

FIG. 10 shows a roughness-gloss graph according to the invention.

It can be seen clearly that, in the known prior art, there is a distinct dependence between the roughness and the gloss of a paper web (dashed-outlined region 110). This is because the two quality characteristics are set by only one step (post-calendering). Low gloss values with low roughnessesz are not possible, which is again disadvantageous in matt paper grades.

By the process according to the invention, on the other hand, low gloss values can be set with low roughnesses. This is because the roughness is determined by the pre-calendering and is no longer made worse in combination with the non-contact coating. In the case of contact coating, a contour coat is applied. The advantage here is that, during the coating, the application medium is not forced into the paper web, which would lead to a certain moistening of the paper web and thus to an increase in the roughness of the paper web. The gloss of the paper web is now set independently of the ability to be calendered, by the parameters of the application medium. These parameters are, for example, the consistency, the formulation, the particle size and shape of the pigments and the like.

By the pre-calendering, substantially better conditions are created for the non-contact application process. This leads, inter alia, to improved coating results because of lower requirements on the viscoelasticity of the application medium.

During the application of the process steps according to the invention, therefore, a woodfree coated, matt or semi-matt paper web can be produced in new quality ranges. The new quality ranges lie within a triangular 120, preferably elliptical 130, contour, which extends in the roughness range from 0.8 to 3.9 μm (PPS) and in the gloss range from 3 to 35% (TAPPI 75°) and, in FIG. 10, is illustrated fully dashed 120 and fully outlined 130.

In order that the importance of the invention is expressed clearly, the quality ranges of woodfree coated paper webs which have been produced in accordance with the production processes known hitherto are also illustrated in FIG. 10. These likewise lie within a preferably elliptical contour 110, which has less beneficial quality values, however, and is illustrated dashed.

In summary, it is to be recorded that, by the invention, a process and an or arrangement for producing a woodfree coated, matt or semi-matt paper web are provided, which permit the production of paper webs in new quality ranges, in particular for matt and semi-matt WFC grades.

Figure 11:
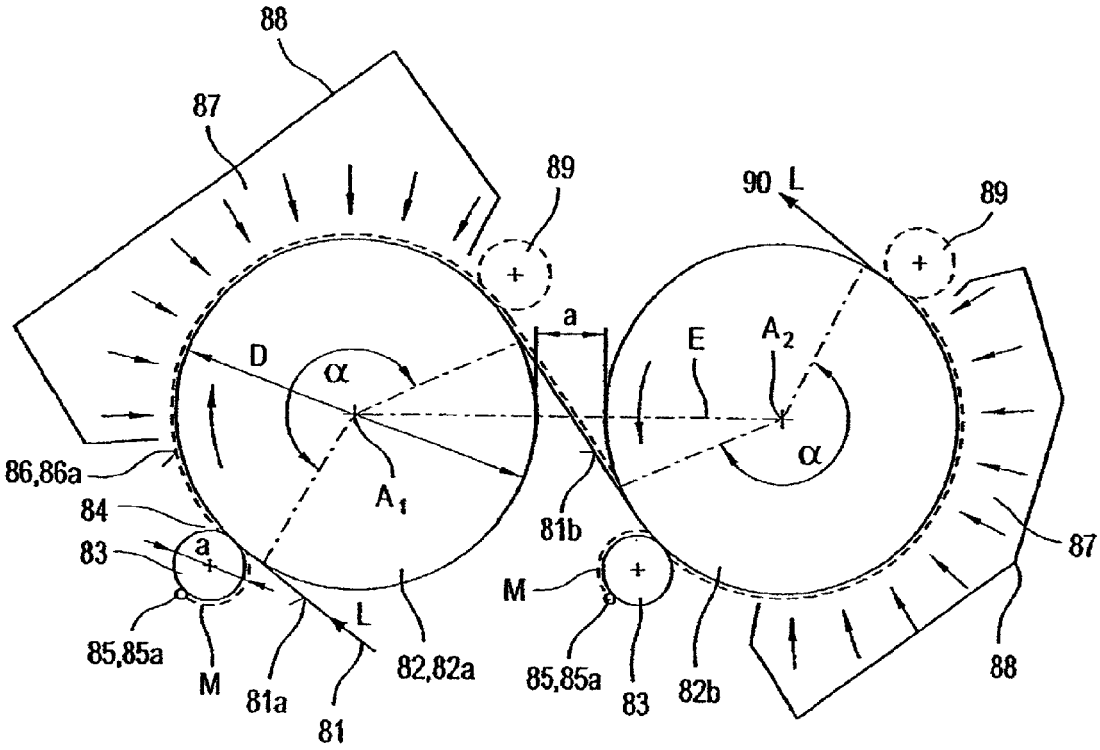
FIG. 11 shows a schematic illustration of an apparatus according to the invention according to the fourth aspect of the invention in side view.

In the illustration shown in FIG. 11, a dry material web 81 is to be coated with an application medium M, in particular a liquid application medium M, in order to improve its subsequent printability. The application medium M used in the example is a coating color which is an aqueous pigment dispersion. However, size or starch can also be applied. In this case, because of the absorption of moisture, the tensile strength of material web 81 decreases, as a result of which this can easily tear or even break, above all in free draws of the web 81.

In order to avoid this, at least one supporting surface 82 is provided, on which the material web 81 runs from bottom to top in the running direction L during the application. The supporting surface 82 used in the example is a rotating roll around which the material web 81 wraps in a wrap angle α of about 180° to 210° and is deflected downward in the process.

On its outer circumference, the supporting surface 82 is assigned an applicator roll 83 for an indirect application of application medium M. For this purpose, the applicator roll 83 forms a nip 84 with the supporting surface 82, in which nip the application medium M discharged by an application device 85 is applied to the material web 81 running around the supporting surface 82. The metering of the application medium M applied to the applicator roll 83 is carried out using a doctor element 85*a* in the form of a doctor blade or a rotatable metering rod.

The application devices 85 that can be used for the indirect application (but the direct application of the application medium M would also be possible) are nozzle applicators or devices acting without contact and without doctor elements, such as curtain nozzle or spray nozzle applicators.

Immediately following the transfer of the application medium M as an application layer 86 to the material web 81, this application layer 86 is dried. The drying is carried out with non-contact dryers 87, which can be both radiant dryers, for example with infrared heating, and also (alternating or in combination) convection dryers, for example air dryers.

By using these non-contact dryers 87, which are likewise assigned to the outer circumference of the supporting surface 82 and which can be located in a common hood 88 in order to avoid heat losses, care is taken of the freshly applied application layer 86.

In order to boost the drying performance for the application layer 86, the supporting roll 82 (82*a*) is of heated design in the example.

In the example, a smoothing device 89 is arranged downstream of the non-contact dryers 87. This smoothing device 89, just like the application device 85 and the non-contact dryers 87, is arranged on the outer circumference of the same supporting surface 82.

In the example chosen, the material web 81 is to be coated on both sides, for which purpose an identically constructed second supporting surface 82*b*, together with the associated application device 85, 85*a*, the dryers 87 and the smoothing device 89 are present.

Since the smoothing device 89 can also be left out in the event of lower requirements, this device 89 is only dashed in each case. The web 81 coming from below is led first around a first supporting surface (roll) 82*a* in the aforesaid wrap angle for treating the first web side 81*a*, because of this angle is deflected downward in the process and, running downward, is supplied to the second supporting surface (roll) 82*b* for treating the other (second) web side 81*b*. The material web 81 again wraps around the supporting surface 82*b* at the same angle as in the supporting surface 82*a* but, now running upward, is deflected to a subsequent treatment location 90. The treatment location 90 is, for example, an afterdryer section, with which the material web 81 and its application layers 86 or 86*a* and 86*b* applied to both sides are dried completely. In addition, the supporting surface 82*b* smoothes the web side 81*a* in accordance with the "cast coating" principle.

It goes without saying that, depending on the requisite end material, further coatings and/or smoothing operations on one or both sides can follow.

Incidentally, it is possible to gather from FIG. 11 that the two supporting surfaces 82*a* and 82*b* are arranged symmetrically in relation to each other, the axes $A_1$ and $A_2$ of the supporting rolls used being located in one plane E. Between the two supporting surfaces or rolls 82*a* and 82*b* there remains only a very small distance a. In this distance, the material web 81 can run in a short free draw.

In addition, it can be gathered from FIG. 11 that the material web 81 wraps around the supporting surface 82 or 82*a* and 82*b* during its deflection, during the application of application medium M, during the non-contact drying of the application layer 86 and also during a smoothing operation. As a result, a very compact, space-saving arrangement, short web running paths and short free web draws are achieved, which results in web breaks being avoided, or at least their number being minimized.

It should be added that the ratio of the diameter D of the supporting surface 82 or 82*a*, 82*b* to the diameter d of the application roll 83 is approximately 4:1, the diameter D being about 4 to 5 m and the diameter d being about 1 to 1.8 meters.

What is claimed:

1. A paper machine for producing a paper, board, tissue or another fibrous web of gravure printing quality, comprising:
- a pressing section having at least one press nip;
- an impingement dryer arranged immediately after the pressing section; and
- a color coating applicator for applying a coating color having a binder for avoiding misting of the coating color during the applying, the applicator being structured and arranged to apply the color coating to a web in the manner of at least one of:
  - a curtain application;
  - a film application; or
  - a spraying application.

2. The paper machine of claim 1, further comprising:
- a first part of a drying section; and
- a second part of the drying section,
- wherein the applicator for applying a coating color is arranged between the first part and the second part.

3. The paper machine of claim 1, wherein the paper machine has a machine speed of more than 1500 m/min.

4. The paper machine of claim 1, further comprising:
- a first drying device arranged after, with respect to a web run direction, the applicator to dry the color coating; and a first support surface structured and arranged to support the web while the color coating is being applied and while the coating color is dried in the first drying device.

5. The paper machine of claim 4, further comprising:

a second applicator arranged after, with respect to the web run direction, the first drying device to apply a second coating color;

a second drying device arranged after, with respect to the web run direction, the second applicator to dry the second coating color; and a second support surface structured and arranged to support the web while the color coating is being applied by the second applicator and while the coating color is dried in the second drying device.

6. The paper machine of claim 5, wherein the applicator and the second applicator are arranged to apply their respective coating color to opposite sides of the web.

7. The paper machine according to claim 1, wherein the applicator is structured and arranged to apply the coating in a non-contacting manner.

8. The paper machine according to claim 1, wherein the coating color is at least one of mechanically and chemically de-aerated to reduce an air content of the coating color to less than 10%.

9. A machine for producing a fibrous web of gravure printing quality, comprising:

a pressing section having at least one press nip;

an impingement dryer arranged immediately after the pressing section; and an applicator structured and arranged to apply a coating color to a traveling web to produce a smooth surface for gravure printing quality web, wherein the applicator is structured and arranged to apply the coating by at least one of:

a curtain application;

a film application; or a spraying application.

10. The paper machine of claim 9, further comprising:

a first drying device arranged after, with respect to a web run direction, the applicator to dry the color coating; and a first support surface structured and arranged to support the web while the color coating is being applied and while the coating color is dried in the first drying device.

11. The paper machine of claim 10, further comprising:

a second applicator arranged after, with respect to the web run direction, the first drying device to apply a second coating color;

a second drying device arranged after, with respect to the web run direction, the second applicator to dry the second coating color; and a second support surface structured and arranged to support the web while the color coating is being applied by the second applicator and while the coating color is dried in the second drying device.

12. The paper machine of claim 11, wherein the applicator and the second applicator are arranged to apply their respective coating color to opposite sides of the web.

* * * * *